United States Patent [19]

Ripple

[11] 4,143,769

[45] Mar. 13, 1979

[54] APPARATUS FOR SORTING AND SEPARATING DISCRETE ARTICLES

[75] Inventor: Jack E. Ripple, Crystal Lake, Ill.

[73] Assignee: Chicago and North Western Transportation Co., Chicago, Ill.

[21] Appl. No.: 793,135

[22] Filed: May 2, 1977

[51] Int. Cl.[2] ..... B07B 13/04; B07C 5/02

[52] U.S. Cl. ..... 209/544; 209/632; 209/674; 209/675

[58] Field of Search ..... 209/97, 99, 73, 74 R

[56] References Cited

U.S. PATENT DOCUMENTS

| | | | |
|---|---|---|---|
| 760,590 | 5/1904 | Vodra | 209/99 X |
| 2,063,008 | 12/1936 | Allen | 209/99 |
| 2,942,792 | 6/1960 | Anderson et al. | 241/14 |
| 3,211,289 | 10/1965 | Brumagin | 209/99 |
| 3,605,767 | 9/1971 | Ettlinger, Jr. | 209/97 |
| 3,672,496 | 6/1972 | Williams | 209/99 |
| 3,738,465 | 6/1973 | Ettlinger | 209/99 |
| 3,799,336 | 3/1974 | Holman | 209/85 |
| 3,840,116 | 10/1974 | Voll | 209/99 |
| 3,883,422 | 5/1975 | Ettlinger, Jr. | 209/75 |
| 3,956,109 | 5/1976 | Dietsche | 209/73 |

*Primary Examiner*—Allen N. Knowles
*Attorney, Agent, or Firm*—Melvin F. Jager; Gary M. Ropski

[57] ABSTRACT

An apparatus for sorting and separating discrete articles such as railroad track material according to shape and size, including an oscillating conveyor, a plurality of spaced parallel bars extending longitudinally along a trough of a sorting end of the conveyor and having leading edges projecting beyond an edge of the trough so that a separating zone is defined, means positioned a spaced distance from the separating zone for receiving a first group of material from the top surface of the parallel bars, and means positioned beneath the separating zone for receiving a second group of smaller-sized material after it falls over the trough edge. The apparatus of the invention also preferably include a hopper, a feeder positioned adjacent the hopper whereby flow of material from the hopper to the oscillating conveyor is regulated, a belt conveyor for transporting the first group of material away from the first receiving means, and an elevating conveyor adjacent the belt conveyor.

18 Claims, 8 Drawing Figures

APPARATUS FOR SORTING AND SEPARATING DISCRETE ARTICLES

BACKGROUND OF THE INVENTION

The invention relates to an apparatus for sorting and separating discrete articles by shape and size, and particularly to a vibratory apparatus for sorting irregularly-shaped material, such as railroad track material. The railroad track material to be sorted and separated is typically accumulated during dismantlement of abandoned lines of track, and includes fasteners and positioning devices such as tie plates, angle bars, rail anchors, spikes, bolts, and nuts.

Sorting of irregularly-shaped material, such as railroad track material recovered from abandoned lines of track, has typically been accomplished by manual methods of sorting and separating the material. Exclusive of steel rails and wooden ties, each mile of railroad track contains approximately fifty tons of fasteners and positioning devices. Much of this material removed from abandoned lines or railroad track, typically about 85 percent, is physically salvageable for reuse. However, manual methods generally have been too expensive, tedious, time-consuming, and inefficient to justify the expense of sorting and separating track material for reclamation.

Mechanical apparatus have also been used for sorting material, particularly articles which are symmetrical about at least one dimension. For instance, Ettlinger U.S. Pat. Nos. 3,605,767 and 3,738,465 disclose a vibrating sorter for soiled tableware, including a vibrating means for separating plates and silverware. The sorting apparatus of Brumagin U.S. Pat. No. 3,211,289 particularly relates to sorting articles of an elongated shape, such as cucumbers and similarly-shaped vegetables. Lastly, Holman U.S. Pat. No. 3,799,336 relates to a method and apparatus for treating discrete articles, including grading the articles by length.

However, such devices have not successfully solved all of the problems of sorting and separating irregularly-shaped material, such as rail anchors and angle bars included among the track material recovered from abandoned railroad lines. Disadvantages of these devices include an inability to efficiently separate two types of irregularly-shaped articles, and a tendency for these articles to become misaligned, and caught on members for the sorting and separating apparatus, thereby jamming the smooth flow of material through the apparatus.

Furthermore, other apparatus designed for sorting railroad track material have included the combination of a hopper, a feeder positioned at the base of the hopper for regulating the flow of material from the hopper, an oscillating conveyor positioned adjacent the feeder to evenly distribute the material and vibrate foreign matter from the material, and a belt conveyor located at a discharge end of the oscillating conveyor. Sorting and separating of the track material is accomplished in this prior art device manually by persons stationed along both sides of the belt conveyor. Material is placed into appropriate containers depending upon the size and condition of the material. Because this apparatus requires and continues to use a high degree of manual sorting and separating methods, it is relatively unproductive, expensive, tedious, and prone to jamming of material in the hopper.

According to the present invention, an apparatus is provided which overcomes the disadvantages of the prior art in sorting and separating discrete articles by shape and size, particularly irregularly-shaped material such as railroad track material. The apparatus of the invention includes an oscillating conveyor having a trough at a sorting end, a plurality of spaced parallel bars provided at the sorting end of the conveyor, a means for receiving a first group of separated material, and a means for receiving a second group of separated material. The plurality of spaced parallel bars have leading edges extending longitudinally along a trough of the sorting end and projecting beyond an edge of the trough so that a separating zone is defined. The first receiving means is positioned a spaced distance from the leading edge of the bars and receives a first group of material from the top surface of the bars. The second receiving means is positioned beneath the separating zone and receives a second group of smaller-sized material. The second group of smaller-sized material includes a first portion which is conveyed on the trough in the sorting end and separated from the first group by falling over the trough edge in the separating zone. A second portion of the second group of material is conveyed in a potentially jammed position on the bars, and is separated from the first group by falling between the leading edges of the bars and the first group receiving means. This second portion of the second group of material is typically comprised of irregularly-shaped articles.

The apparatus of the invention may include several other components which are advantageously combined to increase productivity and efficiency. These additional components include a hopper, a feeder positioned between a discharge opening of the hopper and a loading end of the oscillating conveyor, a belt conveyor for transporting the first group of material away from the first receiving means, and an elevating conveyor adjacent the belt conveyor. A preferred embodiment of the apparatus includes selected dimensions of the plurality of spaced parallel bars, their distances from one another, a projecting distance of the leading edges of the bars, and the spacing between the leading edges of the bars and the first receiving means. The apparatus of the invention provides many advantages. In comparison with manual sorting methods, productivity is increased over previous sorting apparatus because fewer personnel are needed to supervise operation of the sorting and separating apparatus of this invention, to prevent jams and insure proper orientation of material. The increased productivity decreases the number of worker-hours required to sort the track material, and also increases the overall efficiency of the apparatus, thereby justifying the cost of reclamation of used track material according to the present invention when compared with other methods and apparatus of reclamation in view of the cost of purchasing new material. Moreover, this apparatus produces relatively accurate sorting and separating of material with fewer jams, especially when the material has unusual and various irregular shapes typically found in railroad track material.

Accordingly, it is the primary object of this invention to provide a new and more efficient apparatus for sorting and separating discrete articles, particularly irregularly-shaped material, such as railroad track material.

Another object of this invention is to provide an apparatus of sorting and separating discrete articles, including those of irregular shape, which reduces the number of worker-hours required to sort a given load of material, yet maintains sorting accuracy at a relatively high level.

A further object of this invention is to provide an apparatus which not only sorts and separates irregularly-shaped material but also removes relatively loose foreign matter from the material and allows efficient manual inspection of material for removal of unsalvageable parts.

Other objects, features and advantages of the invention will become apparent upon reading the following detailed description in conjunction with the accompanying drawings.

DESCRIPTION OF THE PREFERRED EMBODIMENTS

Figure 1:
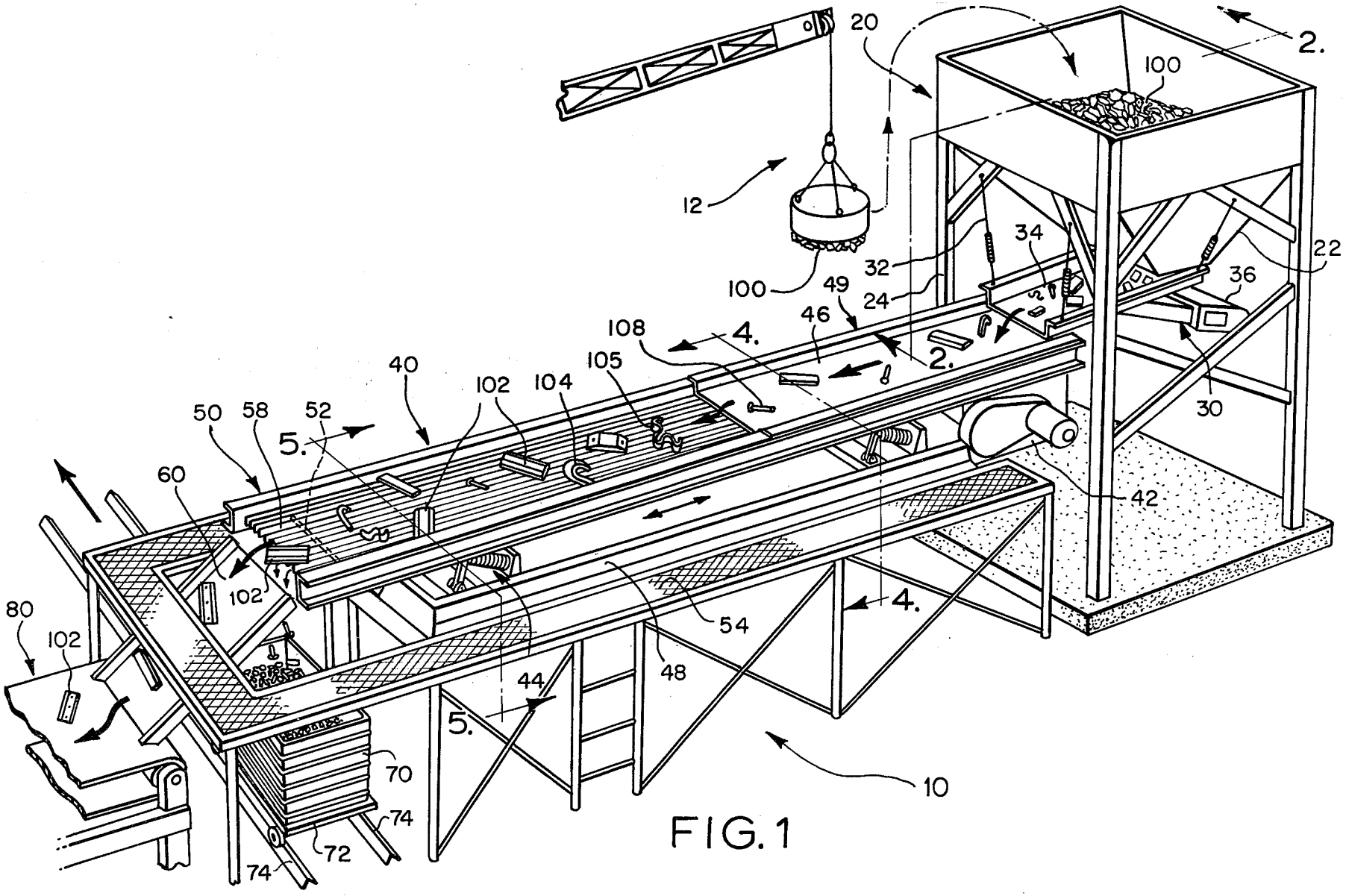
FIG. 1 is a side perspective view of an embodiment of the sorting and separating apparatus of the present invention.
Figure 1A:
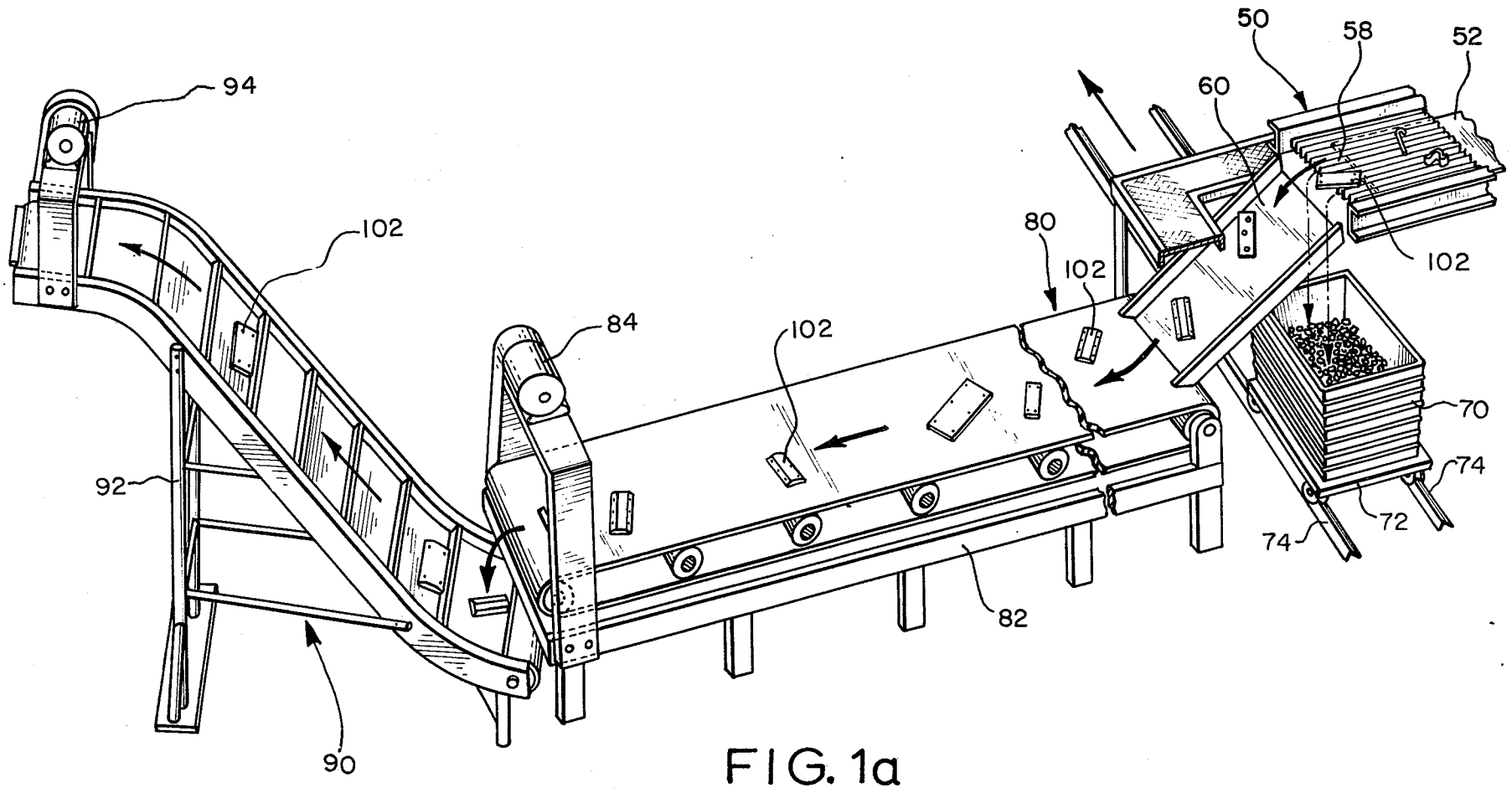
FIG. 1*a* is a side perspective view of the remainder of the sorting and separating apparatus of FIG. 1.

Referring now to the drawings, and more particularly to FIGS. 1 and 1*a*, there is illustrated an apparatus for sorting and separating discrete articles, particularly of irregular shape, indicated generally by the reference numeral 10. This illustrated sorting and separating apparatus as herein described is particularly suited for sorting railroad track material such as tie plates, angle bars, anchors, spikes, bolts and nuts.

The sorting and separating apparatus 10 includes a hopper 20 into which track material 100 is inserted, and a feeder 30 which regulates the flow of material from the hopper 20 to an oscillating conveyor 40. The oscillating conveyor 40 moves the material form a loading end 49 of the conveyor 40 to a sorting end 50. At the sorting end 50, the railroad track material is separated by shape and size so that a first group of material is conveyed to an inclined plate 60, and a second group of material passes through a separating zone of the sorting end 50 to a receiving means. A belt conveyor 80 is provided adjacent the inclined plate 60 for moving larger track material for visual inspection and sorting by quality. An elevating conveyor 90 positioned near the belt conveyor lifts the larger material for deposit at a suitable accumulation area or into a suitable container.

The illustrated hopper 20 includes a hopper body 22 formed in a shape of an inverted, truncated pyramid. The hopper body 22 is supported by a hopper support frame 24. An electro-magnet-equipped crane 12 dumps a load of unsorted track material 100 weighing from four hundred to six hundred pounds into the hopper 20. The hopper 20 provides a target for the crane 12; the capacity of the crane 12 is chosen based upon the cycle time of the crane 12 and the speed with which the hopper 20 can be emptied. Preferably, a load of material which has been placed in the hopper 20 is removed from the hopper 20 by the feeder 30 in the time it takes for the crane 12 to cycle and return with another load. In this manner the frequency and magnitude of possible jams of material in the hopper 20 are reduced because the hopper 20 is loaded at a level less than full capacity.

The feeder 30 is suspended from the hopper 20 by feeder mounts 32, and is positioned beneath a hopper discharge opening 28. The feeder 30 is a suitable electro-mechanical vibratory feeder such as a two-mask spring coupled and eccentric weight excited design. The feeder is adjusted with a slight down slope to most efficiently regulate flow of material through the discharge opening 28 and onto the oscillating conveyor 40.

Figure 2:
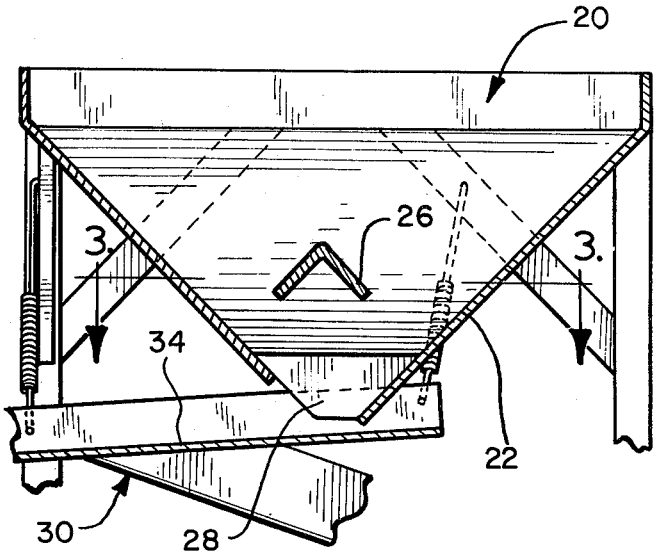
FIG. 2 is a cross-sectional view of the sorting and separating apparatus of the present invention, taken along line 2—2 of FIG. 1.
Figure 3:
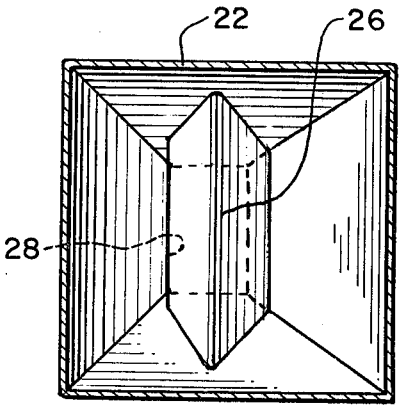
FIG. 3 is a cross-sectional view of the hopper portion of the sorting and separating apparatus of the invention taken along 3—3 of FIG. 2.

As illustrated in FIGS. 2 and 3, the hopper 20 is provided with a deflector bar 26 attached to walls of the hopper body 22 directly above the hopper discharge opening 28. The deflector bar 26 is preferably made of $\frac{3}{4}$-inch thick steel angle iron, and acts as a baffle to deflect track material away from the discharge opening 28. In this manner, the feeder 30 is protected from impact damage caused by the dropping of track material 100 from the electro-magnet of the crane 12 at a height of about ten to twelve feet above the discharge opening 28. The deflector bar 26 also provides some cross alignment to relatively long track material, such as angle bars 106, so that upon reaching the surface of the feeder 30 the main axis of an angle bar 106 is oriented at an oblique angle with respect to the longitudinal direction of travel of material on the oscillatory conveyor 40.

The feeder 30 includes a feeder trough 34 with a trough width chosen to be slightly larger than the width of the hopper discharge opening 28. The feeder is vibrated by a feeder exciter 36 including a motor-driven eccentric weight (not shown) coupled to the trough 34 by means of spring connectors (not shown in a well-known manner.

After the unsorted track material 100 passes through the hopper discharge opening 28 and is fed along the feeder trough 34, it falls onto a loading end 49 of the oscillating conveyor 40, which is preferably operated at 410 r.p.m. with a one-inch throw. As shown generally in FIG. 1, and more particularly in FIG. 4, the loading end 49 includes a conveyor base 48 which supports a trough assembly 51 by means of a spring reactor 44 attached thereto. The trough assembly 51 includes a lower trough 52, a trough support 47 connected to the lower trough 52 along the sides of the trough 52, and an upper trough 46 secured to the trough support 47. A drive assembly 42 provides oscillatory motion to the trough assembly 51. The spring reactor 44 is matched with the frequency of the drive assembly 42 so that the spring reactor, including a pair or springs 43 and a pair of legs 45 pivotally connected to trough assembly 51 and the base 48, operate in the natural frequency range of vibration of the oscillating conveyor 40.

As the material 100 is oscillated over the edge of the feeder trough 34, it falls onto the upper trough 46 of the oscillating conveyor 40. As the material 100 is oscillated along the loading end 49, it is dispersed and disentangled; moreover, relatively loose foreign matter and debris are vibrated from the material 100.

Figure 4:
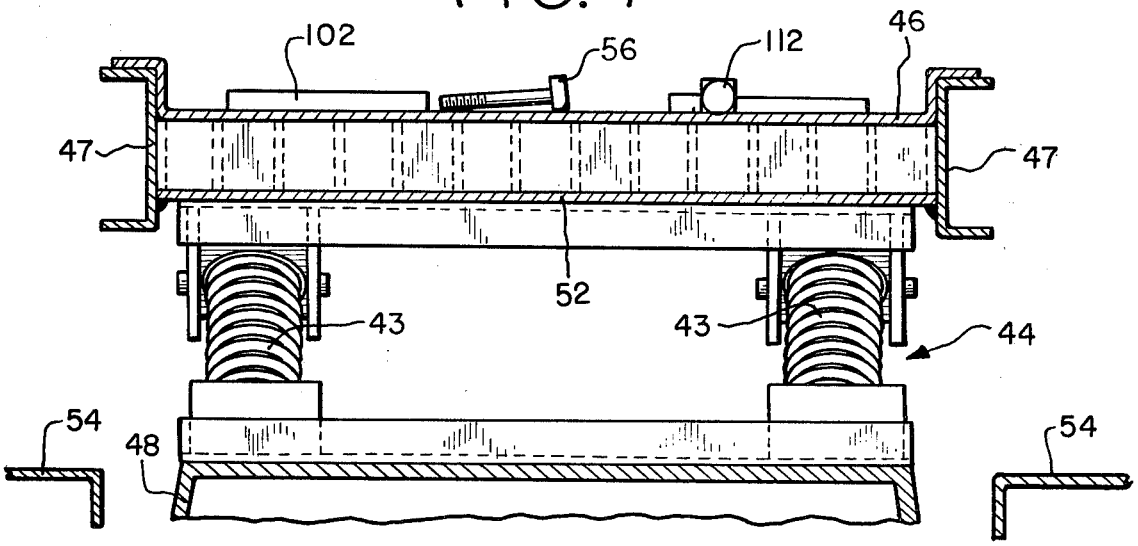
FIG. 4 is a cross-sectional view of the oscillating conveyor portion of the sorting and separating apparatus of the invention, taken along line 4—4 of FIG. 1.
Figure 5:
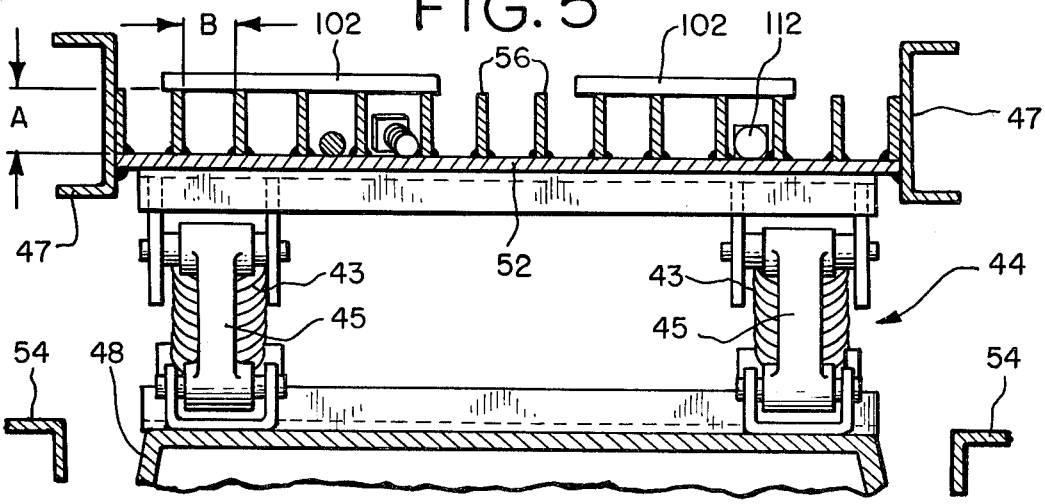
FIG. 5 is a cross-sectional view of the oscillating conveyor portion of the sorting and separating apparatus of the present invention, taken along line 5—5 of FIG. 1.

As the material is oscillated from the loading end 49 it passes over an edge of the upper trough 46 to a sorting end 50, defined by the area commencing with the termination of the upper trough 46. FIG. 5 illustrates, in cross-sectional view, sorting end 50. A plurality of spaced parallel bars 56 in the sorting end 50 are secured to the upper surface of the lower trough 52. Although the bars 56 are illustrated as each having a rectangular cross-section, they can also be substantially oval, square, or round in cross-section. Furthermore, the bars 56 need only be secured to the lower trough 52 at the sorting end 50 at intervals to provide support for material travelling on top of the bars 56. The plurality of parallel bars 56 define two general pathways for material which is oscillated along the sorting end 50: a first group of material is moved on the top of the bars 56, and a second group of smaller-sized material falls between the bars 56 and is moved on an upper surface of the lower trough 52. As described below, the dimensions of the parallel bars and their spacing are chosen to most effectively sort typical railroad track material. Furthermore, as illustrated in FIGS. 1, 4, and 5, a catwalk 54 is provided alongside the oscillating conveyor 40 to permit persons to oversee the oscillation of material and to ensure an even flow of material by manually reorienting when necessary to prevent otherwise uncontrollable jams.

Figure 6:
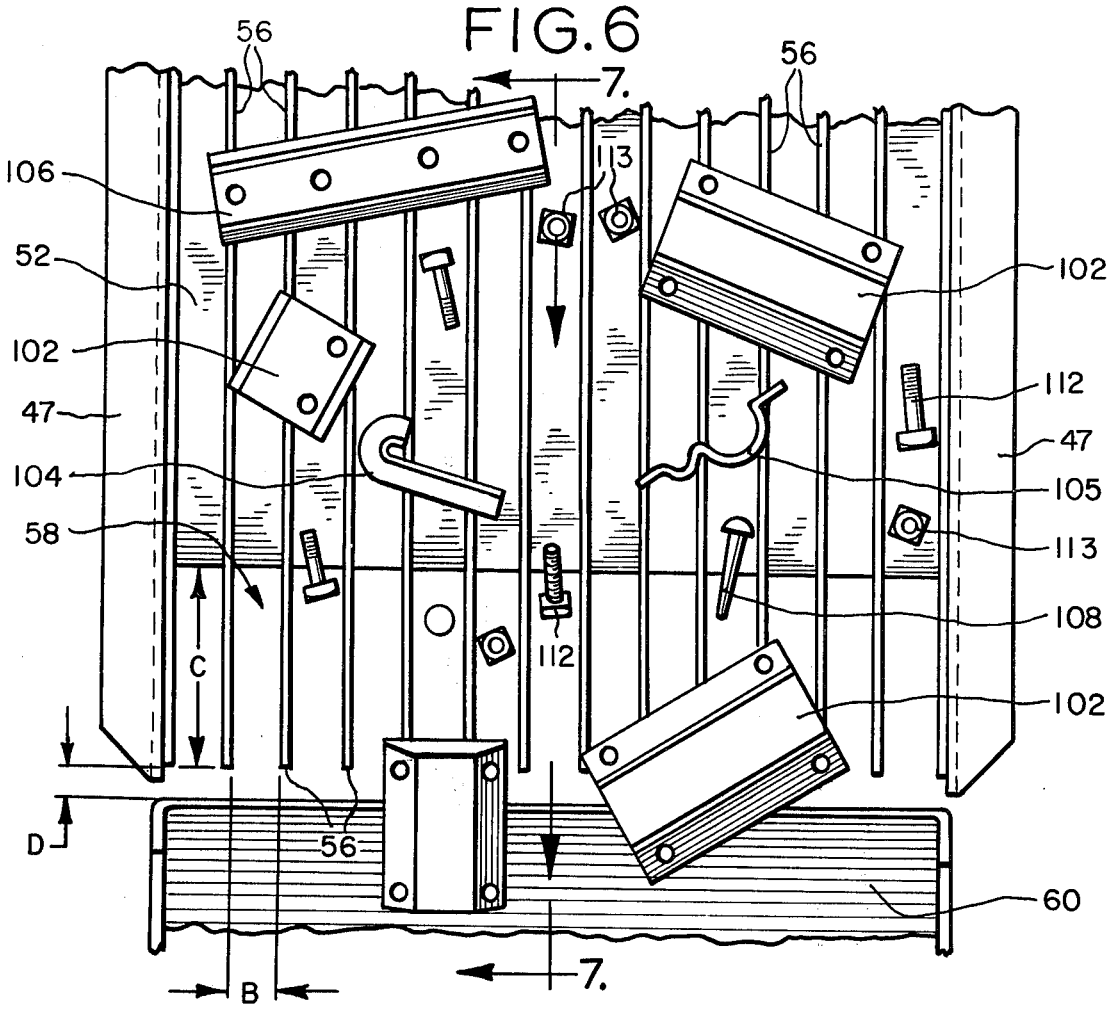
FIG. 6 is a top plan view of a portion of the sorting end of the sorting and separating apparatus of the invention, particularly illustrating the orientation of various types of railroad track material.
Figure 7:
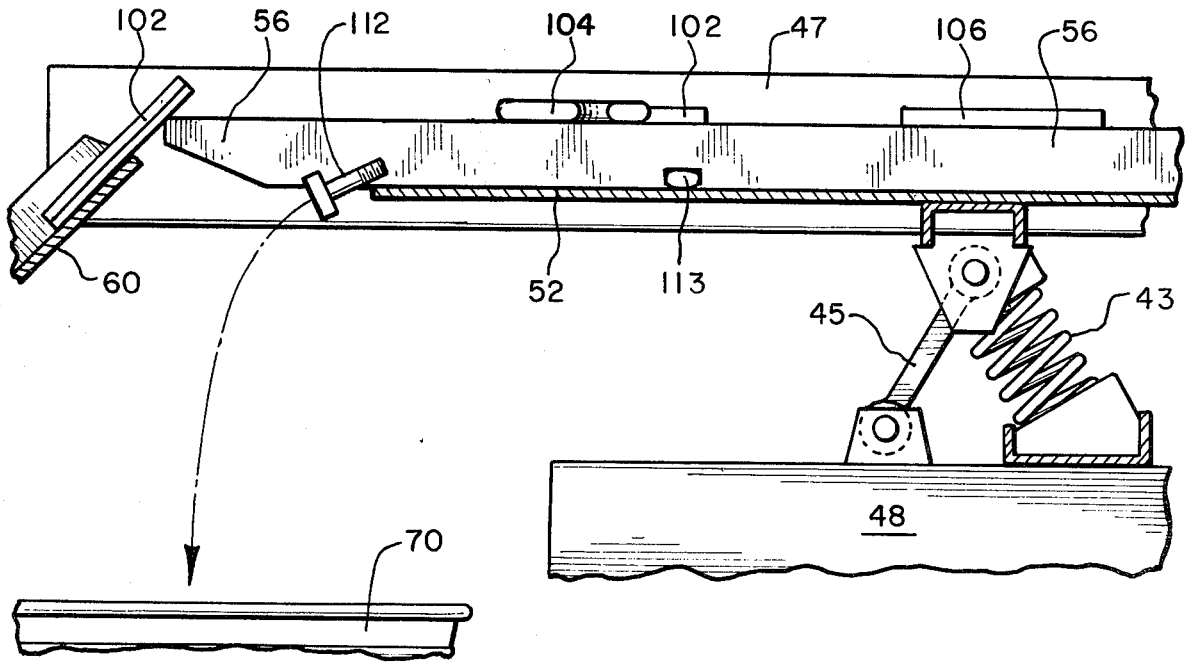
FIG. 7 is a cross-sectional view of a sorting end of the sorting and separating apparatus of the invention, further illustrating the separation of track material.

As is more clearly illustrated in FIG. 6, the plurality of parallel bars 56, along with the trough support 47, project beyond an edge of the lower trough 52 to define a separating zone 58. This separating zone 58 consists of that area in which the parallel bars 56 project beyond the edge of the lower trough 52. It is in this area that the actual separation and removal of the sorted material is accomplished. Larger-sized and shaped material has been moved between the parallel bars 56 and on the lower trough 52 in the sorting end 50. At the separating zone 58 the smaller-sized and shaped material passes over the edge of the lower trough 52, between the parallel bars 56, and falls down to a receiving means 70 as shown in FIG. 7. The larger-sized and shaped material preferably includes single and double-shouldered tie-plates 102 and angle bars 106; the smaller-sized and shaped material includes anchors 104 and 105, spikes 108, bolts 112, and nuts 113. However, the plurality of parallel bars can be so positioned and their dimensions chosen so as to accomplish separating the track material into other groups by shape and size or to sort other discrete articles by shape and size.

The receiving means 70 is typically a container of finite capacity, and provision is made so that several containers may be consecutively positioned beneath the separating zone to receive the second group of smaller-sized material until each container 70 is filled to capacity. For this purpose, each container 70 is placed on a wheeled support platform 72 which rides on rails 74 beneath the separating zone 58. Of course, a suitable conveyor belt may be used in place of the container to accomplish transfer of material from beneath the separating zone.

The inclined plate 60 is supported independently of the oscillating conveyor, preferably by a support means (not shown) secured to the catwalks 54. The plate 60 is inclined at an angle greater than the angle of repose of the material, which is typically between 30° and 45°, thereby permitting constant flow of track material from the separating zone 58 to an adjacent belt conveyor 80. The belt conveyor 80 moves the larger-sized and shaped material from the inclined plate 60 to an elevating conveyor 90. A suitable base 82 and drive assembly 84 for the belt conveyor are provided as known in the art. Personnel can be stationed along each side of the belt conveyor to manually remove unwanted or substandard material which cannot be sorted by size. Alternatively, the personnel can remove all angle bars, scrap tie plates, and tie plates other than a desired size, so that at the end of the belt conveyor only usable tie plates of one size remain. The tie plates 102 and other desirable material drop off the end of the belt conveyor 80 onto the elevating conveyor 90 which lifts them above an appropriate accumulation area or vehicle container for loading and storage.

A typical sorting and separating cycle utilizing the present invention to sort and separate approximately fifty tons of railroad track fastening and positioning material requires approximately three hours. This time period is the same as that typically required for the electro-magnetic crane 12 to unload a gondola (not shown) filled with track material. Productivity using the present invention is substantially greater than purely manual methods, yet it is a productivity gain which is achieved without overtaxing personnel associated with the sorting and separating apparatus. Although personnel are preferably positioned at the sorting end of the conveyor to ensure smooth flow of material, and at the belt conveyor for optional manual sorting operations, a major portion of the sorting and separating of track material is accomplished mechanically by the present invention, thereby increasing the speed, productivity, and efficiency of sorting operations. In order to accommodate optional manual operations, such as additional sorting which may be desired at the belt conveyor 80, controls for the feeder 30 and the belt conveyor 80 are adjustable to ensure that the processing rate is well within the capability of the personnel performing their respective monitoring or inspecting operations.

The apparatus of the present invention can also be used to accomplish further sorting of the smaller-sized and shaped material by manual methods. For instance, a plate (not shown) can be attached to the trough support 47 over the bar 56 to provide a continuation of the upper trough 46. The plate thereby diverts all material over the oscillating conveyor 40 and separating zone 58 and onto the belt conveyor. Actual sorting of the smaller-sized and shaped material is then accomplished by personnel stationed at various places along the belt conveyor, for instance, to remove anchors 104 and 105, bolts 112 and nuts 113, and sort usable, scrap, and reclaimable spikes.

As used herein and as shown in FIGS. 1, 1*a*, and 6, "irregularly-shaped" refers to material or articles which are not symmetrical about at least two dimensions. Such articles typically have a non-linear profile with the center of gravity being outside the structure of the article, such as the generally J-shaped fair anchor 104, and the generally C-shaped and W-shaped anchors 105. This irregular shape permits the articles to become hooked on a rod or bar of a sorting apparatus so that a dimension of the articles extends below the top surface of the rod or bar. These irregularly-shaped articles positioned with such extending dimensions may jam the sorting apparatus of the prior art as they abut other articles and elements of the apparatus.

The various regular and irregular shapes of railroad track material which can be sorted and separated by the apparatus and method of the preferred embodiment require that the parallel bars and other components of the apparatus be dimensioned specifically to accommodate this material. Not all the railroad track material is regularly dimensioned however. Tie plates 102 range from a six-inch height, eight-inch width and $\frac{3}{8}$ inch shoulder height to a $7\frac{3}{4}$ inch length, fourteen-inch width, and 7/16 inch shoulder height. Angle bars 106 have a asymmetrical cross-sectional area with an overall length ranging from twenty-two to twenty-six inches, a width of from $2\frac{3}{4}$ to $3\frac{7}{8}$ inches and a thickness from $1\frac{7}{8}$ to three inches. Depending upon type and size, anchors 104 and 105 include a variety of irregular and asymmetrical shapes, but all can be enclosed in an envelope five inches wide by eight inches long by $1\frac{1}{2}$ inch thick. Reinforced throat track spikes 108 have a maximum width range of $1\frac{1}{2}$ inches to 1 9/16 inches at a maximum length of $5\frac{1}{2}$ to $6\frac{1}{2}$ inches. Bolts 112 come in various sizes and shapes, but typically all are approximately the same size as track spikes 108. Nuts 113 have a width from $1\frac{1}{4}$ inches to 1 3/16 inches and a thickness of from $\frac{3}{4}$ to $1\frac{1}{4}$ inch.

Particular dimensions of the sorting end 50 and separating zone 58 are chosen to maximize the separating efficiency of the invention. In the preferred embodiment, the dimensions are chosen to effectively achieve sorting of track material used in the United States, Canada, and part of Mexico, by separating tie plates 102 and angle bars 106 from anchors 104 and 105, spikes 108, bolts 112, and nuts 113. An article can be positioned on the top of parallel bars 56 in static equilibrium as long as it is supported by three points and the center of gravity of the article falls within the area encompassed by these three points. However, the dynamic conditions of the oscillating conveyor 40 tend to orient material longitudinally in the direction of material travel, thereby reducing the efficiency of separation and also increasing the possibility of jams, particularly if the material is irregularly shaped. For instance, of the types of rail anchors, the clip-type anchor 104 is more asymmetrical. In order to accommodate and prevent jams of misaligned anchors which, for instance, either hook over one or two upright bars or ride upside-down in the spaces between the parallel bars 56, the projecting end of the parallel bars 56 is spaced from the inclined plate 60. Moreover, the length of the separating zone 58 is chosen to allow angle bars 106 to fall over the trough edge if they are oscillated between the parallel bars 56 by providing a length at least as great as the maximum distance from the center of gravity of an angle bar to an external point on the bar. Finally, the inclined plate 60 is positioned a spaced distance below the top edge of the parallel bars 56 to prevent jams if tie plates should be oscillated in an inverted position over the parallel bars 56.

Preferred dimensions for the sorting and separating of track material are illustrated in FIGS. 5 and 6. When $\frac{1}{4}$ inch thick bars 56 are used, the spaced separation B between the bars is preferably $2\frac{3}{4}$ inches, so that the bars 56 are positioned on three-inch centers. An opening D of $1\frac{3}{4}$ inches is preferred between the oscillating conveyor 40 and the inclined plate 60, measured when the oscillating conveyor 40 has reached its maximum throw. The parallel bars 56 preferably extend a distance A which is at least two inches but no greater than three inches above the surface of the lower trough 52, otherwise tie plates 102 that may have tipped into the spaces between the bars 56 are difficult to remove manually. The projection length C of the parallel bars 56 over the edge of the lower trough 52 is preferably twelve inches to allow angle bars to fall through to the container 70 if they should be randomly positioned between the parallel bars 56; however, length C may be a minimum of six inches and may be greater than twelve inches. Lastly, the top leading edge of the inclined plate 60 is preferably a minimum of $\frac{3}{8}$ inch below the top surface of the parallel bars 56 to avoid the possibility of jams if tie plates 102 should ride the top surface of the parallel bars 56 in an inverted position.

In actual operation, the illustrated apparatus of the present invention provides the following separating efficiencies, defined as the percent of that particular material which is separated as desired: tie plates, 98% (2% fall into the container 70); angle bars, 90% (10% fall into the container 70); spikes, 100%; bolts, 100%; nuts 100%; and anchors, 99% (1% pass onto the inclined plate 60). The production rate of operation is approximately $\frac{1}{2}$ ton of material per minute although the apparatus is designed to be run at rates of up to $\frac{3}{4}$ ton per minute.

Though the embodiments hereinbefore described are preferred, many modifications and refinements which do not depart from the true spirit and scope of the invention may be conceived by those skilled in the art. It is intended that all such modifications be covered by the following claims.

I claim:

1. An apparatus for sorting and separating discrete articles of material including irregularly-shaped articles comprising:

an oscillating conveyor having a loading end and a sorting end including a trough therein and adapted for moving the material longitudinally from the loading end forwardly to the sorting end;

a plurality of spaced substantially parallel bars extending longitudinally along the trough and having leading edges projecting a selected distance beyond a forward edge of the trough such that a zone is defined for separating a first group of material and a second group of material containing the irregularly-shaped articles, whereby the first group of material is conveyed on the bars;

means positioned a spaced distance forwardly from the leading edges of the bars for receiving the first group of material from the bars; and means positioned adjacent the separating zone a distance below the tips of said parallel bars for receiving the second group of material, whereby a first portion of the second group of material is conveyed on the trough and separated from the first group by falling over the trough edge in the separating zone, and whereby a second portion of the second group of material conveyed in a potentially jammed position on the bars is separated from the first group by falling between the leading edges of the bars and the first group receiving means.

2. The sorting and separating apparatus of claim 1 wherein the material is railroad track material, and the first group of material includes tie plates and angle bars, and the second group of material includes anchors, spikes, bolts, and nuts, wherein the irregularly-shaped articles include said anchors.

3. The sorting and separating apparatus of claim 1 wherein the spaced separation of the bars is at least about three inches but not more than about four inches.

4. The sorting and separating apparatus of claim 1 wherein the bars are about ¼ inch thick and arranged on about three-inch centers such that an approximately 2¾ inch spacing is provided between the bars.

5. The sorting and separating apparatus of claim 1 wherein the bars have a height of from two to three inches above the sorting end trough.

6. The sorting and separating apparatus of claim 1 wherein the leading edges of the bars project about twelve inches from the edge of the sorting end trough to define the separating zone.

7. The sorting and separating apparatus of claim 1 wherein the distance between the leading edges of the bars in the separating zone and the means for receiving the first group of material, measured when the oscillating conveyor has reached a maximum throw, is between 1¾ inches and three inches.

8. The sorting and separating apparatus of claim 1 wherein the distance between the leading edges of the bars in the separating zone and the means for receiving the first group of material, measured when the oscillating conveyor has reached a maximum throw, is 1¾ inches, and a top edge of the receiving means is positioned at least ⅜ inch below a top surface of the bars.

9. The sorting and separating apparatus of claim 1 wherein the second portion of the second group of material is hooked on the bars such that a dimension of an irregularly-shaped article extends below the top surface of the bars and wherein the spaced distance for positioning the second group receiving means below the tops of said bars is at least equal to the longest dimension of the irregularly-shaped articles extending below the top surface of the bars.

10. The sorting and separating apparatus of claim 1 wherein the loading end includes a trough positioned above the top surface of the parallel bars whereby the material is dispersed and loose debris is removed from the material.

11. An apparatus for sorting and separating railroad track material into a first group and a second group of material, wherein the second group includes irregularly-shaped articles such as anchors, comprising:

a hopper for receiving the material to be sorted and separated;

an oscillating conveyor having a sorting end, and a loading end positioned to receive material from said hopper, said conveyor adapted for moving material longitudinally from the loading end forwardly to the sorting end, the loading end including a trough whereby the material is dispersed and loose debris is removed from the material, the sorting end including a trough having a plurality of spaced substantially parallel bars extending longitudinally along the sorting end trough and having leading edges projecting a selected distance beyond a forward edge of the sorting end trough such that a zone is defined for separating the first group of material and the second group of material, whereby the first group of material is primarily conveyed on the bars;

means, positioned a spaced distance longitudinally from the leading edges of the parallel bars, for receiving the first group of material from the bars;

means, positioned adjacent the separating zone a distance below the tops of said parallel bars for receiving the second group of material, whereby the second group of material is conveyed primarily on the trough and separated from the first group by falling over the trough edge in the separating zone, and whereby an anchor conveyed in a potentially jammed position on the bars so that a dimension of the anchor extends below the top surface of the bars is separated from the first group by falling between the leading edges of the bars and the first group receiving means, said spaced distance between said second group receiving means and the tops of said parallel bars being at least equal to the longest dimension of the anchor extending below the top surface of the bars;

a belt conveyor adjacent the first receiving means for transporting the first group of material away from the first receiving means; and an elevating conveyor adjacent the belt conveyor for lifting the first group of material.

12. The sorting and separating apparatus of claim 11 wherein the first receiving means is a downwardly-inclined plate.

13. The sorting and separating apparatus of claim 11 wherein the second receiving means is a movable container.

14. The sorting and separating apparatus of claim 11 further including a receptacle positioned beneath an unloading end of the elevating conveyor for accumulating the first group of material.

15. The sorting and separating apparatus of claim 11 wherein the bars are about ¼ inch thick, have a height of about three inches above the sorting end trough, and are arranged on about three-inch centers such that an approximately 2¾ inch spacing is provided between the bars.

16. The sorting and separating apparatus of claim 11 wherein lthe leading edges of the bars project about twelve inches from the edge of the sorting end trough, the distance between the leading edges of the bars in the separating zone and the first receiving means, measured when the oscillating conveyor has reached a maximum throw, is about 1¾ inches, and a top edge of the first receiving means is positioned about ⅜ inch below a top surface of the bars.

17. The sorting and separating apparatus of claim 11 further comprising a vibrating feeder positioned below a discharge opening of the hopper whereby flow of material from the hopper is regulated.

18. The sorting and separating apparatus of claim 17 wherein the hopper includes a baffle spanning the discharge opening such that track material impacts the baffle before falling on the feeder and relatively long track material is directionally oriented.

* * * * *